US005875590A

United States Patent [19]

Udelle

[11] Patent Number: 5,875,590

[45] Date of Patent: Mar. 2, 1999

[54] RAINGUTTER LEAF GUARD AND CLEANING DEVICE

[76] Inventor: Steven D. Udelle, 13 Seasons Dr., Punta Gorda, Fla. 33983-5432

[21] Appl. No.: 820,169

[22] Filed: Mar. 19, 1997

[51] Int. Cl.[6] ..... E04D 13/076

[52] U.S. Cl. ..... 52/16; 405/119

[58] Field of Search ..... 405/118, 119, 405/120, 121; 52/11, 12, 13, 17, 15, 16

[56] References Cited

U.S. PATENT DOCUMENTS

| | | | |
|---|---|---|---|
| 2,887,073 | 5/1959 | Thompson | 52/12 |
| 4,183,368 | 1/1980 | Husted | 52/16 |
| 4,304,498 | 12/1981 | George | 52/16 |
| 5,586,837 | 12/1996 | Udelle | 405/119 |

*Primary Examiner*—Tamara L. Graysay
*Assistant Examiner*—Frederick L. Lagman

[57] ABSTRACT

A raingutter leaf guard assembly 8 is mounted on top of a typical rain-gutter 56 to prevent leaves from passing through a grid 12. A hinge portion 24 permits raising the leaf guard assembly 8 when an angled rod 30 affixed to a long pole 32 is mated to a funnel shaped opening 28 in lever 26. A downward pull of pole 32 from ground level raises the leaf guard assembly 8 and dumps leaf debris to the ground. Assembly 9 is comprised of an elbow 44 permanently connected to a raingutter end cap 38. A long pipe 52 is connected to the elbow 44 from ground level. A female duplex hose bib adaptor 54 completes the pipe thread 50, and garden hose thread 55 connections, thereby flushing a gutter clear of debris. All raingutter maintenance is performed on the ground.

9 Claims, 4 Drawing Sheets

8
64
62
16
15
14
12
10
60
30
28
26
32
24
22
20
19
18
34
56
36
37
38
40
42
44
45
46
9
50
52
52
50
48
54
54
55

RAINGUTTER LEAF GUARD AND CLEANING DEVICE

FIELD OF THE INVENTION

The present invention deals with raingutter protection or leaf barriers, but more particularly to a gaingutter leaf guard and cleaning device that is affixed to a typical existing raingutter that is novel, efficient, and is easily maintained or serviceable from the ground level.

BACKGROUND-DISCUSSION OF THE PRIOR ART

Leaves, twigs, and windblown debris are an age old problem with rain-gutters. Many commercial buildings and homes are surrounded by trees in which their leaves will eventually interfere with the flow of rainwater in these nearby gutters, and will have to be cleared of this debris only too often. Screens, meshed wire, and other alternatives have been used as covers for gaingutters, but they too eventually become blocked by debris and require frequent cleaning. Using a ladder, cleaning tool, and hose to clean a first story gutter is risky and time consuming, but using a ladder or crawling on a roof to clean a second story gutter can be dangerous. In many cases, the leaves and debris are not removed by the owners because of this repetitious and risky chore.

SUMMARY OF THE INVENTION

Figure 1A:
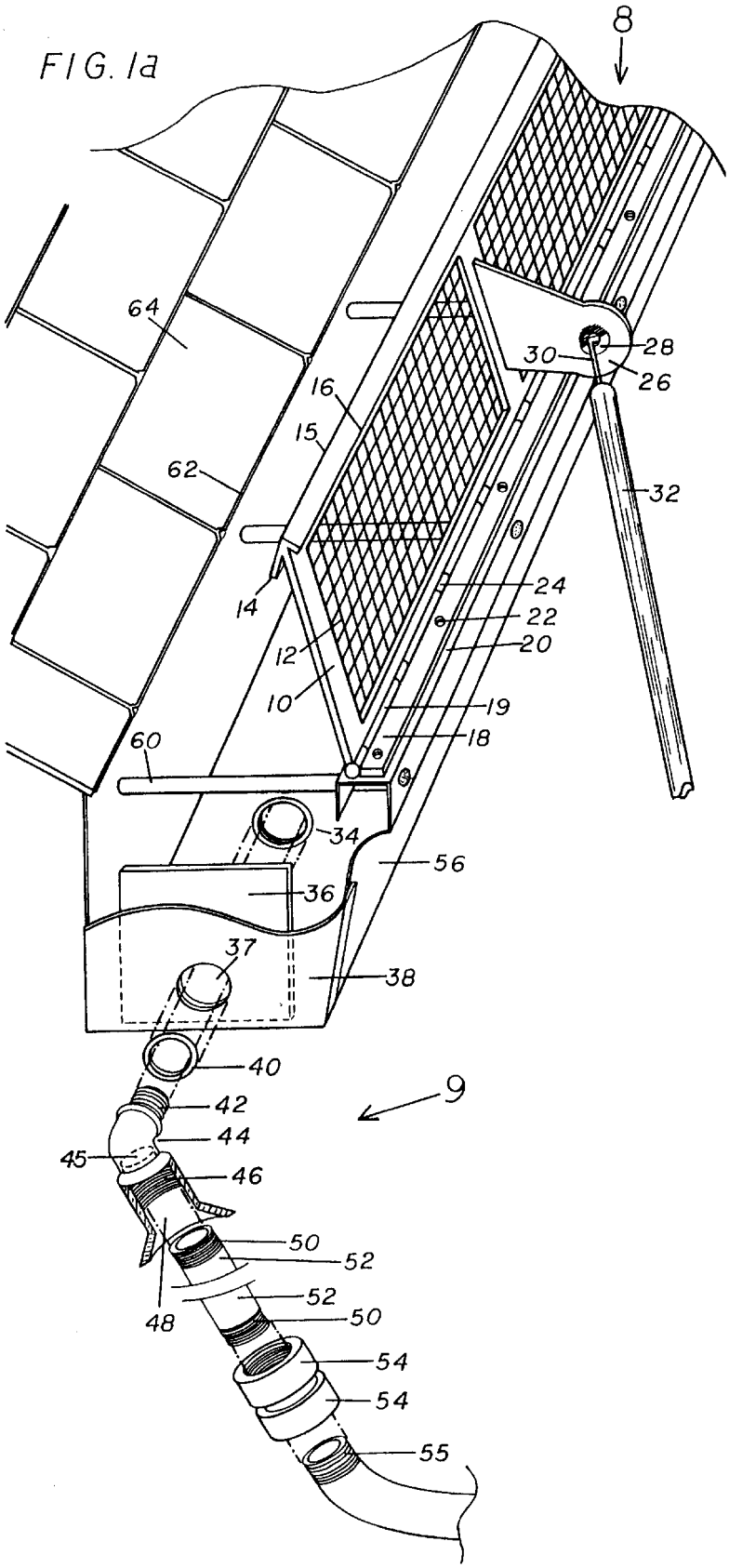
FIG. 1*a* is a preferred embodiment of the present invention in a perspective view of a partial section of a raingutter leaf guard, shown partly open and affixed to a typical (6) six inch raingutter, with an exploded perspective view of a plumbing assembly shown partly in hidden lines, cross section and section.

Debris-choked raingutters spill their unchanneled water over plantings alongside the home, create elongated holes in the ground, splash mud against the brick or painted house surface, dislodge plants on occasion and wash ground cover or mulch away. These undesirable occurrances require time, energy, and a financial outlay to restore. Generally, the present invention is comprised of an elongated raingutter cover assembly or leaf guard, made in sequential lengths or sections, for laying on the topside of a typical existing raingutter. One longitudinal edge of the cover assembly has an integral hinge portion, and the other half of a hinge portion is fastened by screws to the outside top horizontal edge of the raingutter. The opposite longitudinal edge of the cover assembly rests on the nail ferrules, or strap hangers that hold the entire gutter to the fascia. A substantial portion of the cover assembly consists of grid openings. A vertical oriented lever or bracket is mounted and prominent to the center of the cover assembly. The upper portion of the lever has an opening with a tapered wall similar to a funnel. A pole of sufficient length having a small diameter rod bent at a right angle and attached thereto, is inserted into the funnel-shaped opening from the ground level, thus guiding the rod into the vertical lever opening very easily. To remove small twigs and leaves adhering to the cover assembly grid openings, a simple pull downwards of the pole from ground level will raise the hinged raingutter cover assembly, thereby swinging the entire cover assembly 180 degrees over the gutter outside edge to a horizontal, upside-down position, thereby dumping the debris to the ground. A rapid up and down movement of the pole will shake stubborn debris loose. A garden hose can also be employed at ground level to remove stubborn debris adhering to the grid openings while the cover assembly is suspended upside-down outside the gutter area. An upward movement of the pole will quickly restore the cover assembly to its original position at the top opening of the rain-gutter. A pole with a built-in telescopic extension similar to a swimming pool maintenance pole, is used to flip and dump debris from the cover assembly mounted to a second story gutter very easily. The cover assembly is preferably mounted higher at the rear of the gutter, thereby presenting a downward slope toward the front edge of the gutter to provide an easy slide-off of leaves in light wind conditions. A 90 degree elbowhaving an interior check valve is inserted through a predrilled hole in the endcap of the raingutter and is threadably affixed to a locking ring. The elbow points downward, and has a flared female pipe guideway with a recessed threaded opening for receiving a sufficiently long pipe having male threads which are easily mated to the elbow from the ground level. The opposite end of the pipe has a male thread and is mated to the first end of a turnable female duplex hose bib adaptor. The female turnable hose bib fitting on the second end of the adaptor, threadably mates to an ordinary garden hose, thereby providing a water flushing means performed at ground level for removing miscellaneous debris and shingle aggregate that periodically builds up in the gutter floor. The threaded pipe can be coupled to additional lengths to flush a second story raingutter. The elbow is installed at the opposite end of the downspout location.

It is therefore an object and advantage of the present invention, to easily maintain or service a raingutter from the ground level.

Another object of the invention is to save time, energy, and financial outlay in hiring an outside service.

Another object of the invention is that the use of ladders is no longer required, thereby preventing potential accidents from occurring.

Another object of the invention is to extend the life of metal gutters, as wet debris on the metal gutter floor takes much longer to dry, and the unpainted metal surface is subject to accellerated corrosion and pitting through the action of electrolysis.

Other objects and advantages may readily be determined by the following teachings.

COMPLETE DESCRIPTION OF THE INVENTION

FIG. 1*a* is a perspective view of the preferred embodiment of the present invention in a partially open position, showing a substantial portion of an elongated raingutter leaf guard or cover assembly 8, a typical (6) six inch raingutter housing 56, and a piping or plumbing assembly 9 shown in an exploded view with a portion in cross section. Raingutter cover assembly 8 is comprised of a solid perimeter frame 10 integral to partial hinge loop 24, mated to an elongated mounting strip 18 integral to a second partial hinge loop 19. Both oversized hinge loop portions 19 and 24 are mated sufficiently loose to an interior hinge rod, not shown, to prevent hinge binding and to compensate for gutter surface 20 high spots, as the elongated strip 18 is fastened to the outside top horizontal surface 20 of raingutter housing 56 by a series of screws 22. A solid perimeter frame 10 provides sufficient rigidness surrounding integral grid member 12. An angled blade 14 protruding downward under one side of cover assembly 8 provides rigidity to perimeter frame 10 and serves as a support beam above nail ferrules 60. Angled blade 16 protruding upwards on the top side of cover assembly 8 also provides additional rigidity to perimeter frame 10 while serving as a fence or barrier to leaves entering the gutter in a gap between the rear-most edge 15 of cover assembly 10 and the shingle 64 overhang 62. The centermost area of cover assembly 8 has a vertical oriented lever or bracket 26 containing a funnel shaped opening 28 for mating with angled rod 30 affixed to pole 32. Pulling pole 32 downward, lifts the cover assembly 8, 180 degrees from a horizontal position over the gutter opening to a horizontal position upside down outside of the gutter for dumping or shaking leaf debris off of the device grid surface 12. Piping or plumbing assembly 9 jointly provides a clean raingutter network when combined with cover assembly 8, and both are completely serviceable by the building owner from the ground level. Piping assembly 9 shown in an exploded view, is comprised of a 90 degree elbow 44 containing a downflow check valve 45 shown in hidden lines, a male pipe thread 42 on the elbow outlet side, a gasket 40, a backing plate 36 also used as a hole 37 template, behind gutter end cover 38, shown in partial cutaway, and an electrical fitting locking ring 34. The female inlet portion of elbow 44 in partial cross section, shows a typical female hose bib thread 46 recessed within a funnel shaped pipe guiding sleeve 48 for easy mating of male threaded portion 50 of pipe 52 shown in section, and female thread 46. The opposite end of pipe 52 has a male hose bib thread 50 that mates to a first turnable portion of a duplex or back to back garden hose adaptor 54. The inlet portion of the second turnable female hose adaptor 54 is then mated to a typical garden hose thread 55. To flush extraneous material or accumulated shingle aggregate laying on the gutter floor surface, simply place the male threaded end 50 of the elongated pipe 52 into the funnel shaped guiding sleeve 48, and with a pushing motion, rotate the male thread 50 into the recessed female thread 46, the connection will not require a gasket washer. The elbow 44 remains permanently affixed to gutter endcap 38. The lower, or opposite end of the elongated pipe 52 is mated to a duplex hose bib adaptor 54 and finally to the garden hose 55. Opening the hose bib faucet provides a strong horizontal stream of water into the gutter floor surface., thereby flushing debris and shingle aggregate (damaging to metal when wet for prolonged periods of time), to the opposite end containing a downspout. When flushing is completed, disconnect all accessories from elbow 48 and store. This prodecure is the same for a second story gutter, except for coupling several more lengths to threaded pipe 52.

Figure 1B:
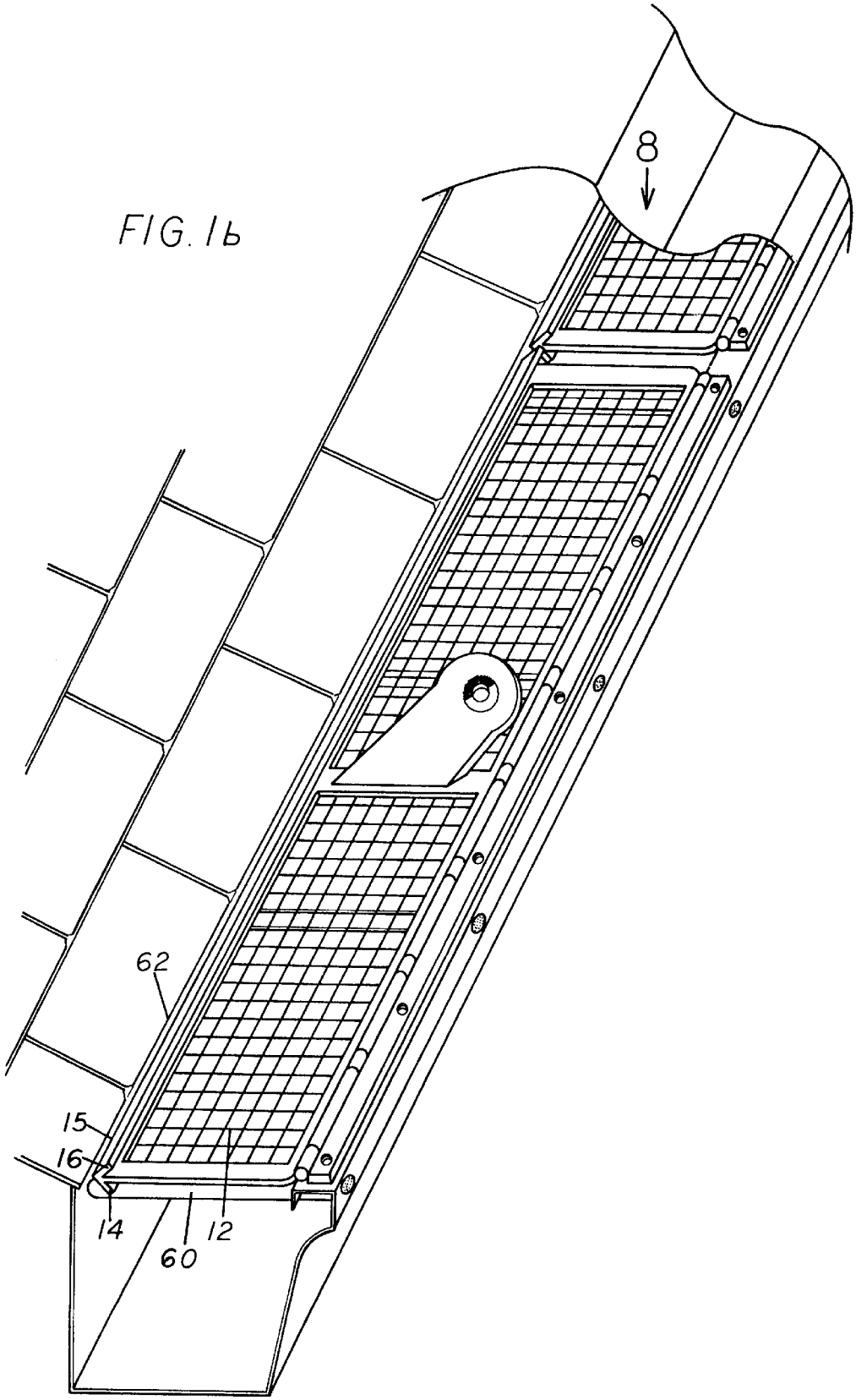
FIG. 1*b* is a perspective view of the raingutter leaf guard in an operational position, and also showing a portion of a second leaf guard section and their relationship to a typical raingutter and shingle overhang.

FIG. 1*b* is a perspective view of the raingutter cover assembly 8 as described in FIG. 1*a*, and a partial section view of another continuing section or length of cover assembly 8 shown in a closed working position affixed to a typical gutter housing 56 and resting on nail ferrules 60. The furthermost rear edge 15 of the cover assemblies 8 are provided with a sufficiently spaced gap from the shingle overhang 62 to prevent binding of both cover assemblies 8 when pulled to an open position. The top angled blade 16 is positioned slightly below the shingle overhang 62 to prevent impeding water flow into the cover assembly grid 12. The top angled blade 16 provides a fence or barrier to prevent windblown leaves from wedging inside the gap between the shingle overhang 62 and the rear edge 15 of the cover assemblies 8. The bottom angled blade 14 can have a longer extension, whereby it can be bent, cut, or notched, over the top surface of each nail ferrule 60 or strap hanger if used, for the best alignment and slope of the cover assemblies edge 15, and upper angled blade 16 in respect to the shingle overhang 62. It would be preferable to have the rear portion of the cover assemblies 8 as high as possible to maximize the downward slope towards the front of the raingutter for easier leaf slide-off in breezy weather conditions. The grid 12 serves as an excellent means for allowing large volumes of fast moving rainwater to pass through their respective openings with negligible backsplash. The grid 12 of cover assemblies 8 can be comprised of galvanized hardware cloth of various opening dimensions, or of a non-metallic material that would be impervious to freeze-thaw cycles and ultraviolet rays. Each section, or sequential length of cover assemblies 8 may be die punched or molded from a single sheet member. The cover assembly 8 may be made so that a portion can be trimmed off or removed. A return spring can be employed behind the cover 8 and affixed to the gutter. The cover assembly lever 26 may be foldable for more efficient packaging. A U-shaped, adhesive-filled, soft plastic automobile trim molding may be affixed to the bottom edge of beam 14 to prevent possible rattling noises caused from strong winds. The mass of the cover assembly 8 and its openness is sufficient enough to remain in place during severely strong wind conditions.

Figure 1C:
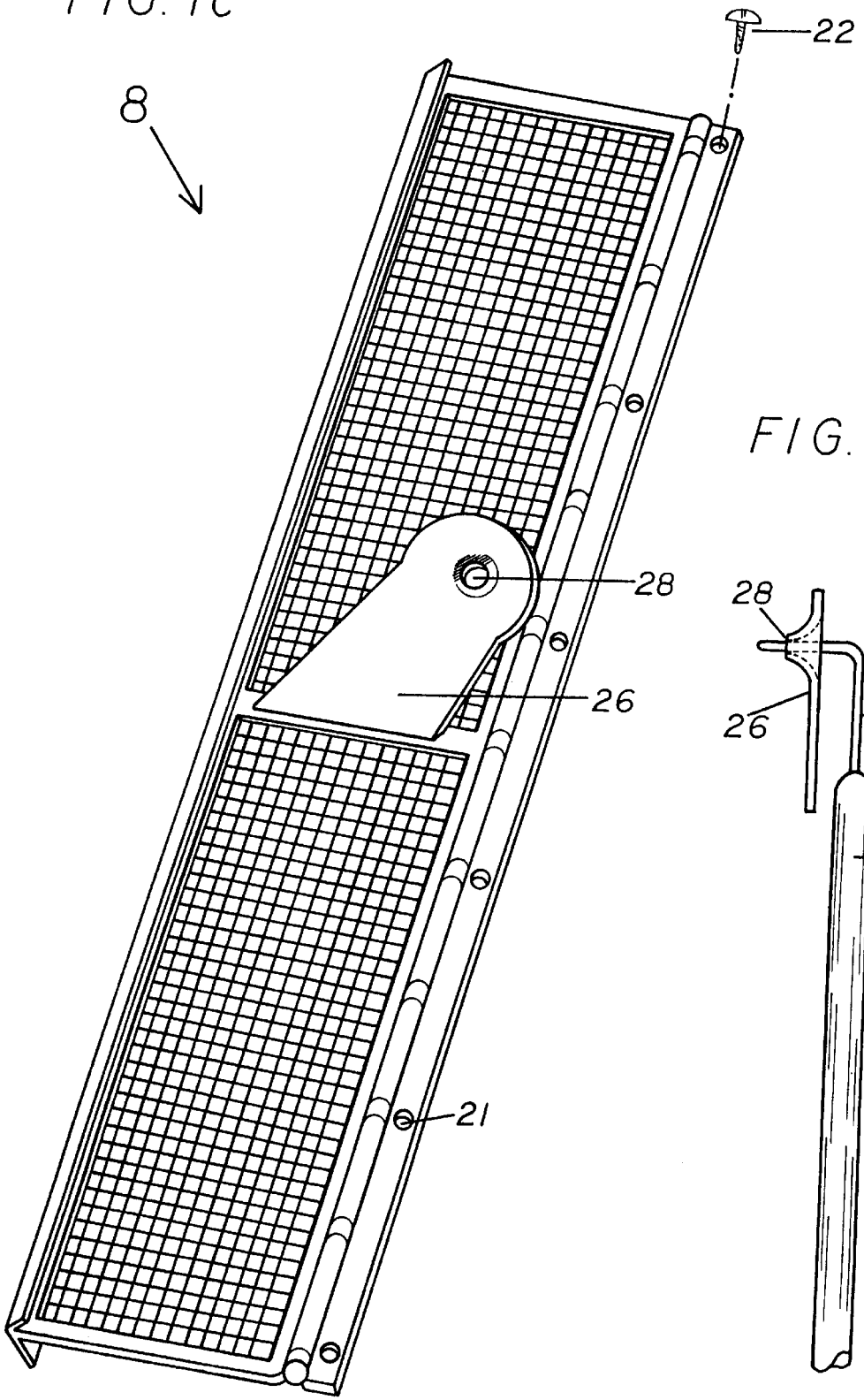
FIG. 1*c* is a perspective view of a section of raingutter leaf guard as it will appear before packaging.

FIG. 1*c* is a perspective view of the raingutter cover assembly 8 before packaging, showing equally spaced holes 21 for insertion of screws 22. All other elements are fully described in FIGS. 1*a* and 1*b*.

Figure 1D:
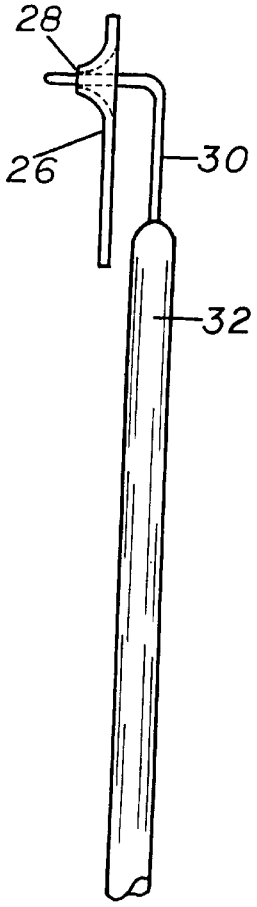
FIG. 1*d* is a plan side view of the operating pole assembly and a plan end view of the lever assembly in better detail.

FIG. 1*d* is a plan side view of an elongated pole 32 affixed to a metal rod bent at a right angle 30, and mated through a funnel shaped opening 28 of lever 26 shown in an end view for better illustration.

Figure 1E:
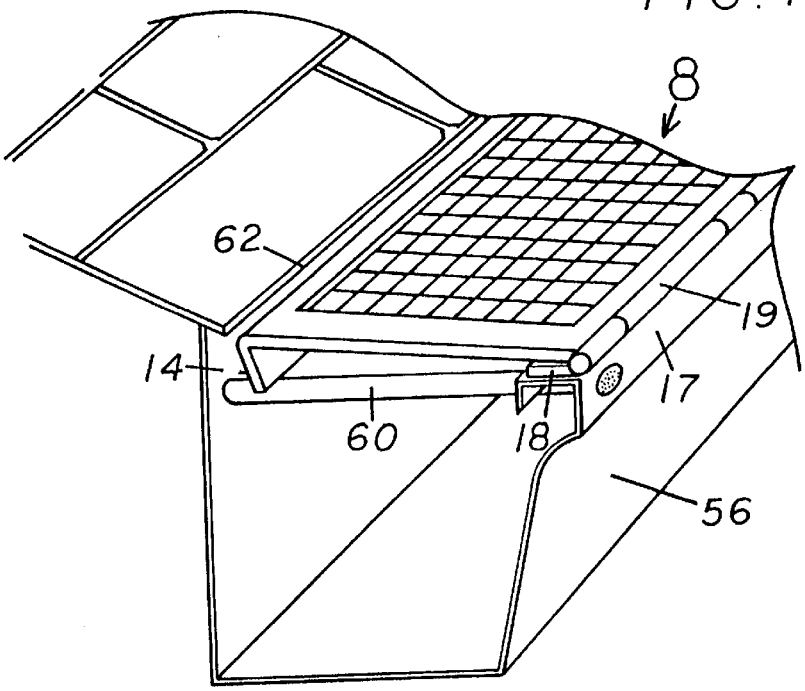
FIG. 1*e* is a perspective view of an alternate method of mounting the hinge of a raingutter leaf guard to accommodate a typical (5) five inch gutter. The leaf guard leaf barrier shown in FIG. 1*a* may be deleted to provide a greater elevation and therefore slope from rear to front of the leaf guard. The raingutter leaf guard of FIGS. 1*a* and 1*e* are identical in overall width, whereby one size is functional for both (5) five inch, and (6) six inch raingutters.

FIG. 1*e* is a perspective view in partial, of the raingutter cover assembly 8 in a closed position, showing the elongated mounting strip 18 integral to partial hinge loop 19 repositioned to the outside of the nail face 17 of a (5) five inch gutter housing 56. The mounting strip 18 is folded under the main body of cover assembly 8. The angled blade 14 has a longer extension for bending, cutting, or notching above the surface of nail ferrules 60 to position the rear portion of cover assembly 8 as high as possible to maximize the slope downward towards the front of the gutter for easier leaf slide-off in breezy wind conditions. The angled blade 16 as described in FIG. 1*a* has been deleted from the rear top portion of cover assembly 8 to show an increase in the slope angle. Further details are discussed in FIG. 1*f*.

Figure 1F:
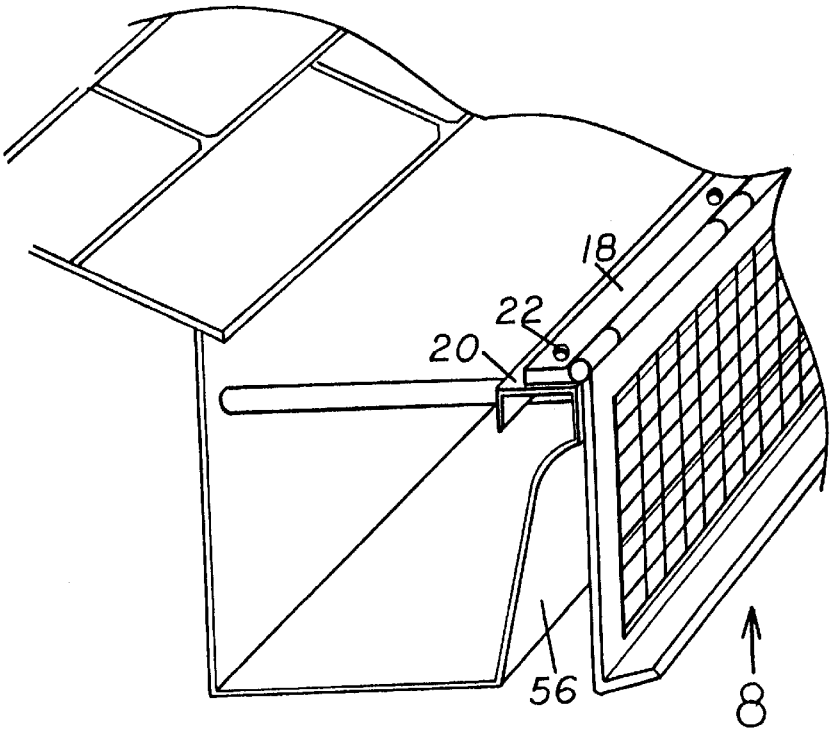
FIG. 1*f* is a perspective view of the raingutter leaf guard in a fully retracted position on a typical (5) five inch gutter.

FIG. 1*f* is a perspective view of a portion of the raingutter cover assembly 8 shown in a 270 degree extended position. The elongated mounting strip 18 is fastened by screws 22 to the outside top horizontal surface 20 of a (5) five inch gutter housing 56. Thus it has been shown that the same raingutter cover assembly can perform all of the objectives as outlined above and can further be used for standard (5) five and (6)

six inch gutters, thereby saving on stocking two width sizes, and considerable expense, by folding the mounting hinge portion 18 underneath the main body cover 8 for (5) five inch gutters, and laying the mounting hinge portion 18 flat as shown in FIG. 1*a* alongside of the main body cover 8 for (6) six inch gutters. In freeze-thaw climates, nail support ferrules or strap hangers are on two foot centers, and in the tropics the nail ferrules or hanger straps are spaced between three and four foot centers. These spacings are sufficient in most cases to evenly support the rear of the raingutter cover assemblies. The cover assemblies can be made in increments of one foot or less, and as long as twelve feet.

CONCLUSION

The above descriptions can be modified by various methods for producing the same result; for example, it would be obvious to employ remote controlled servo-motors in place of a hook and pole if the need was necessary in spite of the expense. It would also be obvious to make the raingutter cover assemblies trimmable, and to use different shaped grids, or different perimeter frame designs. It would also be obvious to curve the raingutter cover assembly into a convex shape.

While the specifications may contain many specific details, these should not be construed as limitations on the scope, concept, or synergism of the invention, but rather as examples of embodiments or modifications herein detailed in accordance with the descriptive requirements of law. It should be understood that the details are to be interpreted as illustrative and not in a limiting sense.

I claim:

1. A raingutter leaf guard and cleaning device comprising:

a) an elbow, said elbow having a horizontally disposed outlet and a vertically disposed inlet, and b) said horizontally disposed outlet of said elbow affixed to a rain-gutter, and c) said elbow includes a downflow check valve disposed therein said elbow between said horizontally disposed outlet and said vertically disposed inlet of said elbow, and d) said vertically disposed inlet of said elbow having an integral over-sized opening preceeding said inlet of said elbow, whereby a removably attached length of pipe is easily guided into said inlet of said elbow by a human from ground level for flushing debris from said raingutter.

2. The device of claim 1, wherein said over-sized opening preceeding said inlet of said elbow comprises an integral funnel-shaped extension of said inlet of said elbow.

3. The device of claim 1, wherein said horizontally disposed outlet and said vertically disposed inlet of said elbow include threads disposed in their respective openings.

4. The device of claim 3, wherein said removably attached length of pipe includes threads at its first end and its second end.

5. The device of claim 4, wherein said removably attached length of pipe having threads at its second end, is threadably mated to a hose.

6. The device of claim 5, wherein said hose conveys a means for flushing debris and shingle aggregate from said raingutter.

7. The device of claim 4, wherein said removably attached length of pipe having threads at its first end, is threadably mated to said vertically disposed inlet of said elbow.

8. The device of claim 1, wherein said horizontally disposed outlet of said elbow is permanently affixed to an end of said raingutter.

9. The device of claim 1, wherein said removably attached length of pipe used by a human from ground level may be put in storage after flushing debris and shingle aggregate from said raingutter.

* * * * *